US007664421B2

(12) United States Patent
Fromm

(10) Patent No.: US 7,664,421 B2
(45) Date of Patent: Feb. 16, 2010

(54) HOT AIR CONVECTIVE GLOSSER

(75) Inventor: Paul M. Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 526 days.

(21) Appl. No.: 11/552,670

(22) Filed: Oct. 25, 2006

(65) Prior Publication Data

US 2008/0166652 A1 Jul. 10, 2008

(51) Int. Cl.
*G03G 15/20* (2006.01)

(52) U.S. Cl. ..... 399/92; 399/122; 126/66

(58) Field of Classification Search ..... 399/92, 399/122; 126/66
See application file for complete search history.

(56) References Cited

U.S. PATENT DOCUMENTS

| | | | | |
|---|---|---|---|---|
| 6,514,653 | B1 * | 2/2003 | Tavernier et al. | 430/109.4 |
| 6,535,712 | B2 * | 3/2003 | Richards | 399/341 |
| 2003/0148205 | A1 * | 8/2003 | Alexandrovich | 430/111.4 |
| 2005/0219641 | A1 * | 10/2005 | Kitano et al. | 358/448 |
| 2007/0280758 | A1 * | 12/2007 | Ciaschi et al. | 399/336 |

* cited by examiner

*Primary Examiner*—Hoa V Le
(74) *Attorney, Agent, or Firm*—Oliff & Berridge, PLC

(57) ABSTRACT

A system and method to control image gloss in an electrophotographic system or the like using hot air convective heating of the toner image on a recording medium.

20 Claims, 4 Drawing Sheets

HOT AIR CONVECTIVE GLOSSER

BACKGROUND

This disclosure relates generally to image production in electrophotographic systems and, more particularly to systems and methods for image gloss control.

A conventional apparatus for forming a image using an electrophotographic system generally uses a system in which an image formed of a toner is carried on an image carrying member, such as a photoreceptor drum and an intermediate transfer belt, and the image is transferred and fixed to a recording medium such as paper.

This kind of image forming apparatus may have, as a fixing device for rapidly fixing the toner image to the recording medium, a fixing unit, the recording medium containing the toner image being nip-transported under heating and pressing between a pair of fixing rolls, which are rotated in contact with each other. Such systems are generally referred to as fusers because they fuse the toner image to the recording medium.

Many documents produced by such systems, and, especially color printers, have a need for a uniform, high gloss. However, many fuser issues can lead to non-uniform gloss or a gradual change in gloss as the fuser ages. Examples of fuser roll induced gloss defects include edge wear, oil streaks, and air knife streaks such as from cool rings (due to non-uniform cooling of the fuser roll or recording medium after fusing) and random wavy gloss and gloss reduction as material accumulates on the roll that contacts the image. Post fuser temperature disparities also alter the image gloss. Post fuser gloss defects include belt hole artifacts from the post fuser belt transport.

Many of the roll-induced gloss defects improve when the fuser roll is replaced. However, if the gloss defects could be cured by a post-fuser heating process, useful fuser roll lifetimes could be extended by at least a factor of two and likely more.

SUMMARY

In accordance with one aspect of the disclosure a hot air convection glosser unit is provided just downstream of the fusing station in an electrophotographic image forming system. The glosser unit includes a sheet transporter operable to receive a sheet to which an image has been fixed and to transport the sheet, a sheet holder for holding the sheet on the sheet transporter, and a hot air source operable to provide hot air for convective heat transfer to at least a portion of the sheet during transport of the sheet. In addition, the glosser can include a cooling unit to assist in cooling the sheet and/or the sheet transporter.

In accordance with another aspect of the disclosure, a duplex hot air convection glosser unit is provided having two hot air convection glosser units provided in series so as to heat a first side of the sheet and then heat a second side of the sheet after the toner on the first side has cooled sufficiently.

In accordance with yet another aspect of the disclosure, a duplex hot air convection glosser unit is provided having a single hot air convection glosser unit, and further including a sheet reversing unit operable to receive the sheet after its first side has been heated and sufficiently cooled reverse the orientation of the sheet (turn it upside-down) and then send the sheet through the glosser unit again so as to heat the toner image on the second side of the sheet.

DETAILED DESCRIPTION OF EXEMPLARY EMBODIMENTS

US 2005/0219641 A1 (Kitano et al.) discloses an electrophotographic image forming apparatus in which a radiant heater is disposed downstream of the fusing station. The radiant heater includes a lamp and reflector to supply radiant energy to the fixed toner image to affect the glossiness of the final image. However, different materials will heat-up by different amounts depending on their ability to absorb radiant energy. For example, most toners are made predominantly from transparent thermoplastic materials that do not absorb much radiant energy. The amount of radiant energy absorbed by such toners depends largely on the type of pigment used in the toner, with black pigments typically absorbing much more radiant energy than colored pigments. Thus a radiant heater may not be a good choice for incorporation into a color image forming apparatus. A convective heater, on the other hand, should uniformly heat toners of all colors (including black).

Figure 1:
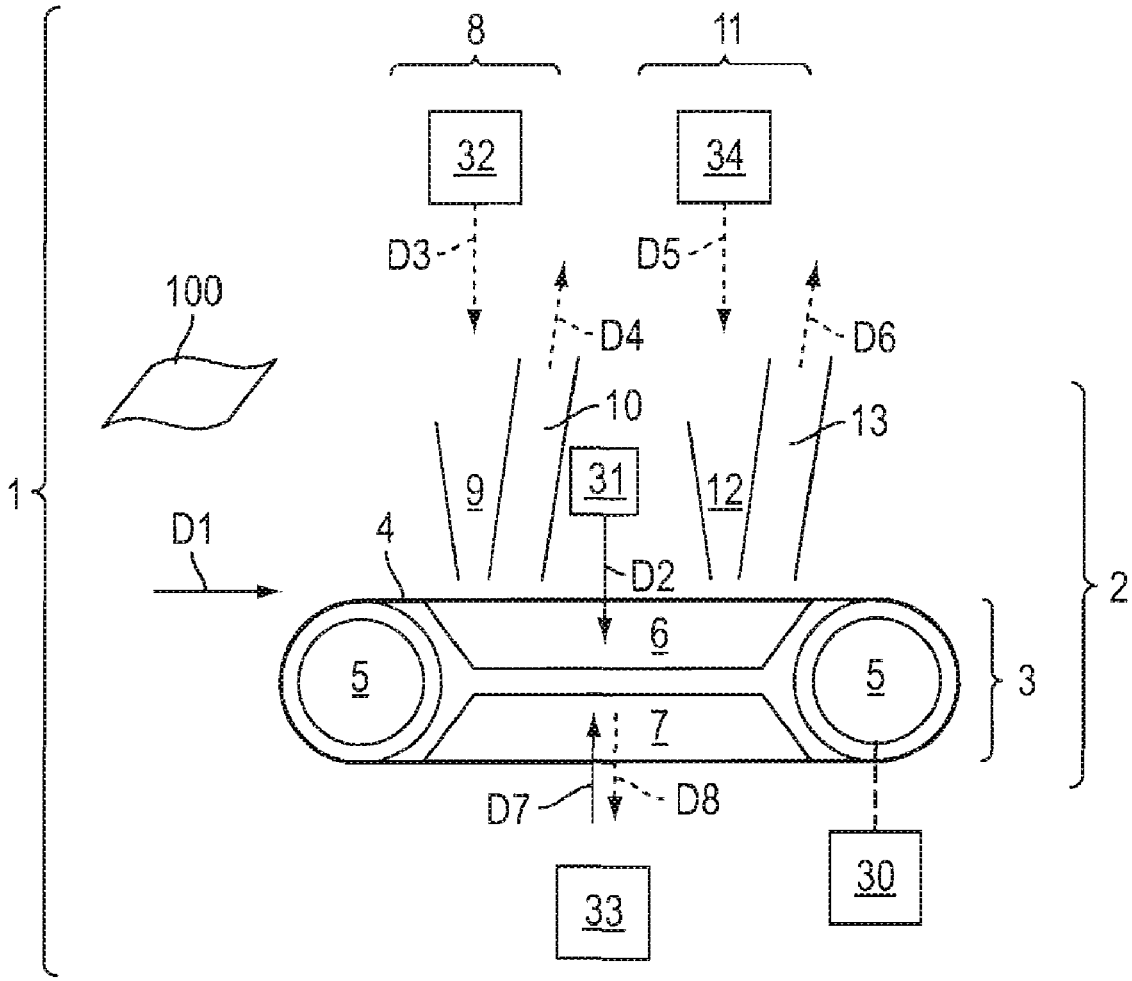
FIG. 1 is a schematic view of a single-sided hot air convection glosser system described herein.

Referring to FIG. 1, the hot air convective glosser system 1 of the current example is a single-sided hot air convective glosser system 1 having a hot air convective glosser 2. Single-sided hot air convective glosser 2 of the current example is able to reheat a fixed toner image on a recording medium 100 to correct for defects and produce a superior image gloss with improved consistency and uniformity, preferably without causing sheet distortion.

In the current example, hot air convective glosser 2 has sheet transporter 3 which receives, holds, and transports recording medium 100.

In the current example, sheet transporter 3 has a belt 4 supported on rollers 5. Belt 4 can be of any suitable material, including rubber or woven fiber. In the current example, sheet transporter 3 is operated by a motor 30 that drives at least one of the rollers 5. However, both rollers can be driven or an external roller in contact with belt 4 could be driven, driving the sheet transporter 3. In the current example, rollers 5 are hollow and made of a highly heat conductive material to facilitate cooling of belt 4. Additionally, air can be blown longitudinally through rollers 5 to further increase the cooling of rollers 5.

Sheet transporter 3 receives recording medium 100 from the fuser of the electrophotographic system that incorporates the glosser system 1. For example, hot air convective glosser system 1 can be disposed just after the fuser (not shown) so that sheet transporter 3 receives recording medium 100 directly from the fuser nip exit. In other variations, hot air convective glosser system 1 can be disposed later in the electrophotographic system. In still other variations, hot air convective glosser system 1 can be included in other systems or even as a stand-alone unit for image gloss improvement and can receive a recording medium 100 directly from the user.

Once sheet transporter 3 begins to receive the recording medium 100, sheet transporter 3 begins holding the recording medium 100. In the current example, sheet transporter 3 holds recording medium 100 by suction in direction of arrow D2. In this example, belt 4 has a plurality of holes or pores. If belt 4 is rubber, the pores can be formed by pressing, molding, drilling, laser removal, perforating, or other suitable means. If belt 4 is woven, the fiber and weave need to be chosen to produce pores that are sufficiently numerous and small. In order that shadow images of the pores do not form in, or telegraph to, the toner image during operation of the hot air convective glosser 2, the maximum pore size should take into account the minimum recording medium thickness, the stiffness of the material of the recording medium 100, and the strength of the suction. For example, the thickness of the recording medium 100 preferably is at least several times the maximum diameter of the pores. As one example, for a recording medium 100 thickness of 0.2 mm, a maximum pore diameter of 0.1 mm can be used. Additionally, the material of belt 4 must be able to withstand the temperature imparted by the hot air. Conversely, in a woven belt structure, where most of the surface is open, the fiber diameter or contact zone with the surrounding medium should be several times smaller than the recording media thickness.

In the current example, sheet transporter 3 has plenum 6, connected to a vacuum source 31. In operation, the vacuum source 31 creates a vacuum, or volume of low pressure, in plenum 6, thereby creating a suction force through the pores of that portion of belt 4 disposed over the plenum 6. When recording medium 100 is in contact with the belt surface over the plenum 6, the vacuum force will act on the side of recording medium 100 in contact with the belt 4, which results in recording medium 100 sticking to the surface of sheet transporter 3. Thereafter, as sheet transporter 3 moves, it transports recording medium 100 in the direction of D1. Other suitable methods for holding recording medium 100 to the sheet transportation surface include, for example, by electro-static adhesion.

As recording medium 100 moves in the direction of D1, it passes under heating unit 8. In the current example, heating unit 8 includes a hot air source 32 which supplies hot air for convective heat transfer through supply space 9 in direction D3 to the exposed surface of belt 4 or any toner image on the exposed surface of recording medium 100 located below space 9. In the current example, hot air source 32 can be, for example, heating coils and a fan (or blower) to blow the air heated by the open, resistive coils in the direction of arrow D3. Alternatively, resistive heaters may be enclosed in a finned structure to increase the surface area of the air heater thereby reducing the temperature difference between the air and heater. The hot air source 32 also may be, for example, wires exposed to moving air, wires encased in ceramic and metal jackets, quartz-halogen lamps, semiconductor heaters embedded into a finned structure or free standing in air, many types of combustion heat exchangers also are possible but may not be practical. In general, any means of heating a moving air stream can be used.

In the current example, supply space 9 can be, for example, a duct, a pipe, or other suitable structure able to guide high or very high velocity hot air in direction D3 to the surface of recording medium 100, The optimum air velocity impinging on recording medium 100 depends on many parameters including, but not limited to, the velocity of the recording medium 100, the temperature of the hot air, the desired power levels required by the hot air source 32, and the desired noise levels. Lower air velocity allows for lower power to move the hot air and, likely, lower noise, but requires higher hot air temperatures with, likely, a higher risk of scorching the recording medium 100. Higher air velocity allows for lower hot air temperatures, and, likely, lower risk of scorching recording medium 100, but requires higher power to move the hot air, and, likely, higher noise. Generally, the optimum air velocity will be in the range of 6 to 30 meters per second and, more preferably, 12 to 20 meters per second. After the hot air impinges onto the surface of belt 4 or the recording medium 100, it is removed (exhausted) in direction D4 through removal space 10. In the current example, removal space 10 can be, for example, a duct, a pipe, or other suitable structure able to conduct the hot air away from the surface of recording medium 100. For example, the hot air removed through removal space 10 can be removed, such as by a fan, for example. In such configurations, the removed hot air can be reheated and resupplied through supply space 9. However, in other variations, for example, the removed hot air can be exhausted outside of the system. Preferably, removal space 10 has a cross-sectional area greater than the cross-sectional area of supply space 9 to accommodate lower air pressure during the air removal process.

In the current example, as depicted in FIG. 1, as recording medium 100 is transported on sheet transporter 3, recording medium 100 will first encounter supply space 9 and will receive hot air, which is then removed through removal space 10 as the recording medium 100 moves further along in the direction D1. Removal of the hot air facilitates quick cooling of the toner so that the high-gloss finish produced by the convective heating is not damaged by subsequent handling of the sheet.

Preferably, the hot air temperature upon contact with the recording medium 100 is as hot as possible without causing recording medium 100 to scorch or burn. For example, the hot air temperature can be set to the highest temperature at which, if the hot air continuously impinges on a stationary recording medium 100, the recording medium 100 does not burn within 3 seconds. This allows sufficient time for a shutdown of the hot air source 32 or to activate a valve to direct hot air from supply source 9 to removal space 10 without impinging on the recording medium 100, in the event of a paperjam or the like. For example, the hot air temperature on contact with the recording medium 100 can be 200 to 300 degrees Centigrade.

Alternate temperature control paradigms are possible, including, but not limited to, settings which are varied with the type of recording medium 100 used or sensed or the type of toner used or sensed. Additionally, the velocity of the belt 4 of the sheet transporter 3 or the dwell time of recording medium 100 under the hot air convective glosser 2 can be adjusted to control the heat amount supplied to the toner image. Additionally, it is possible to control the temperature of the hot air supply, so long as the capabilities of hot air source 32 allows it, in a cyclic or periodic manner, such as by lowering the temperature of the hot air when there is no recording medium 100 on belt 4.

Additionally, various control paradigms are possible for the flowrate of the hot air. For example, hot air source 32 can be controlled to supply hot air only when recording medium 100 is under heating unit 8. In other variations, hot air source 32 provides a stream of hot air only when sheet transporter 3 is operating.

In the current example, a sheet transporter cooling unit is used to cool the sheet transporter 3. In the current example, the sheet transporter cooling unit includes, for example, a plenum 7 connected to a cooling air source 33. The cooling air source 33 can operate by sucking or by blowing cool air through plenum 7 to cool the belt 4. For example, cooling air source 33 can be the same device as vacuum source 31 drawing air through belt 4 in the direction of D7. According to another example, cooling air source 33 can be a refrigeration unit or can operate by supplying air from the environment surrounding the device of which hot air convective glosser system 1 is a part, blowing air through belt 4 in the direction D8. In further variations, cooling air source 33 can be the same source as the source for cold air convection cooler 12, discussed below. In variations of the current example, the sheet transporter cooling unit can be controlled to operate only when the temperature of sheet transporter 3, or components thereof, reach a predetermined temperature. In other variations, a predictive control can be used which takes into account the change in temperature with time as well as the level of activity of the hot air convective glosser system 1 or the electrophotographic system or other system of which hot air convective glosser system 1 is a part.

In variations of the current example, after recording medium 100 has passed under heating unit 8, recording medium 100 is allowed to cool naturally while being transported. In such systems, after recording medium 100 has passed heating unit 8, sheet transporter 3 will pass recording medium 100 on to another system within the electrophotographic system or other system of which hot air convective glosser system 1 is a part, or, if hot air convective glosser system 1 is in a standalone unit, to the output bin or other facility.

The recording medium 100 needs to be cooled so that subsequent handling or contact will not damage the superior gloss imparted by the hot air convective glosser system 1. Thus, the current example includes a cooling air convection unit 11 to cool recording medium 100 before subsequent handling or contact can damage the reglossed image. In the current example, cooling air convection unit 11 includes a cooling air source 34, which supplies cooling air through supply space 12 in direction D5 and through a removal space 13 through which the cool air is removed in direction D6 after contact with belt 4 or the heated toner image on recording medium 100. Cooling air source 34 can be, for example, a refrigeration unit or a device that draws air from the environment that surrounds the electrophotographic system or other system in which hot air convective glosser system 1 is a part. Supply space 12 can be, for example, an enclosed duct, a pipe, etc. As in the heating zone 8, the velocity of the air in supply space 9 and 12 must be high to increase the convective heat transfer coefficient. Removal space 13 can be for example, a duct, a pipe, etc. In variations of the current example, the cool air removed through removal space 13 is recirculated, such as by a fan, for example. In such configurations, the removed cool air is recooled and resupplied through supply space 12. However, in other variations, for example, the removed cool air can be exhausted outside of the system. Preferably, removal space 13 has a cross-sectional area greater than the cross-sectional area of supply space 12 to accommodate lower air pressure during the air removal process.

Figure 4:
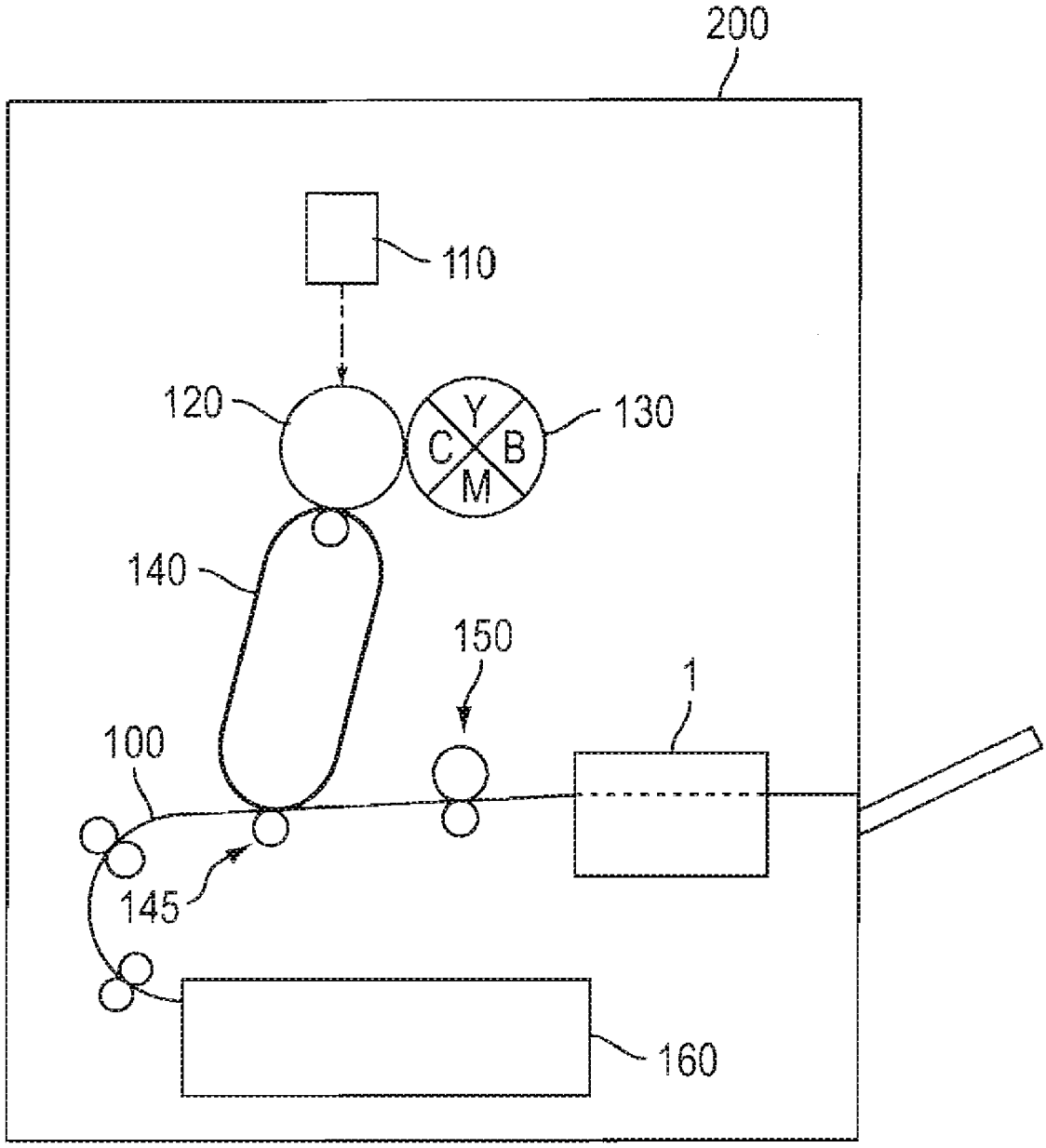
FIG. 4 is a schematic representation of an electrophotographic imaging system incorporating a hot air convective glosser.

The hot air convective glosser 1 can be included in an electrophotographic image forming apparatus 200 as shown in FIG. 4. The apparatus 200 forms color images and includes a photoreceptor 120 on which a latent image is formed, for example, by a laser imaging device 110 (based on image data input by scanning an original document or by other means). The photoreceptor 120 is selectively contacted with toner supplies of different color toners (Cyan, Magenta, Yellow and Black in this example) by toner cartridge 130. The different color toner images are transferred to intermediate belt 140. The different color toner images are transferred from intermediate belt 140 to the recording medium 100 supplied from supply bin 160, with the toner image transfer taking place at point 145. The toner image is fixed to the recording medium at fuser 150 and then the fixed image has its glossiness improved by hot air convective glosser 1. With the exception of the glosser 1, the components of apparatus 200 are well known. See, for example, US 2005/0219641 A1, the disclosure of which is incorporated herein by reference in its entirety.

Figure 2:
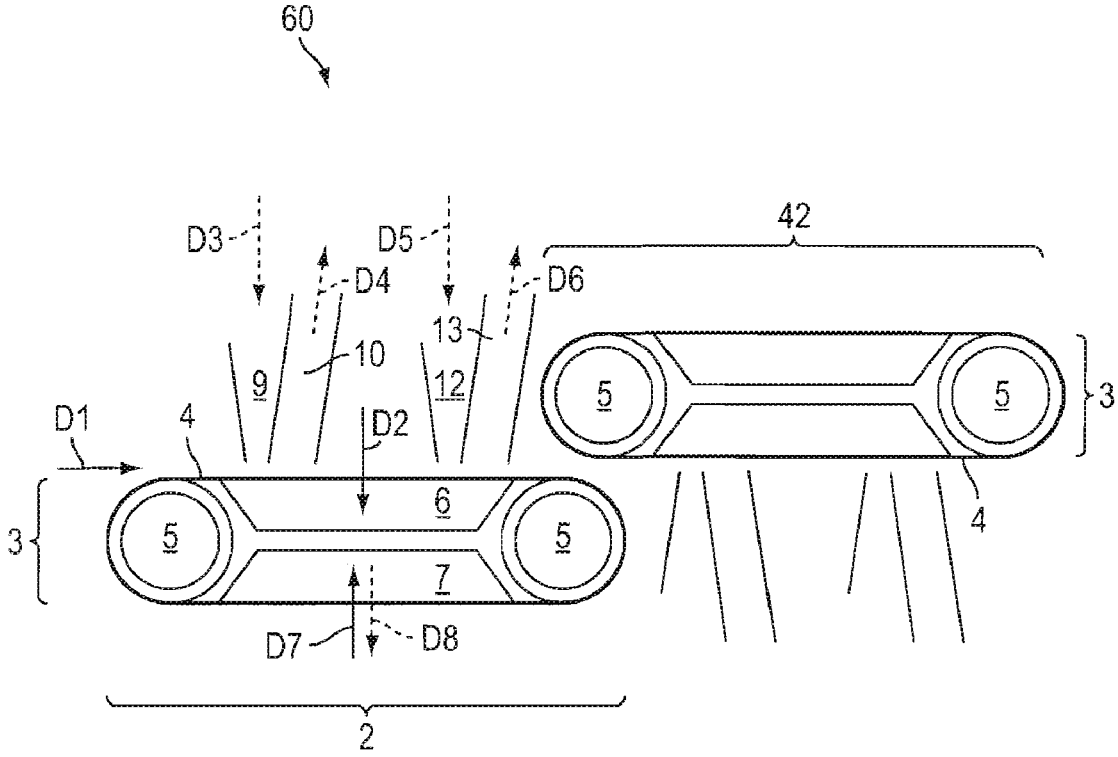
FIG. 2 is a schematic view of a duplex hot air convection glosser system described herein.

Referring to FIG. 2, hot air convective glosser system 60 is shown having a first hot air convective glosser 2 and a second hot air convective glosser 42. As depicted in FIG. 2, hot air convective glosser 42 is identical to hot air convective glosser 2 except that it is inverted. However, each of hot air convective glosser 2 and hot air convective glosser 42 can be individually configured as needed and can be different from each other. In configurations as depicted in FIG. 2, hot air convective glosser 42 receives recording medium 100 directly from hot air convective glosser 2 and then heats the toner image on the bottom side of the recording medium 100 to improve its glossiness. However, other components can be disposed between hot air convective glosser 2 and hot air convective glosser 42 if desired.

Because the upper surface and image of recording medium 100 that was exposed and reglossed in hot air convective glosser 2 subsequently contacts the belt 4 of hot air convective glosser 42, it is important that the toner image on the upper surface cool sufficiently before contacting the belt 4 of glosser 42. As discussed in relation to FIG. 1, a cooling air convection unit 12 can be included in hot air convective glosser 2 to achieve such cooling.

Figure 3:
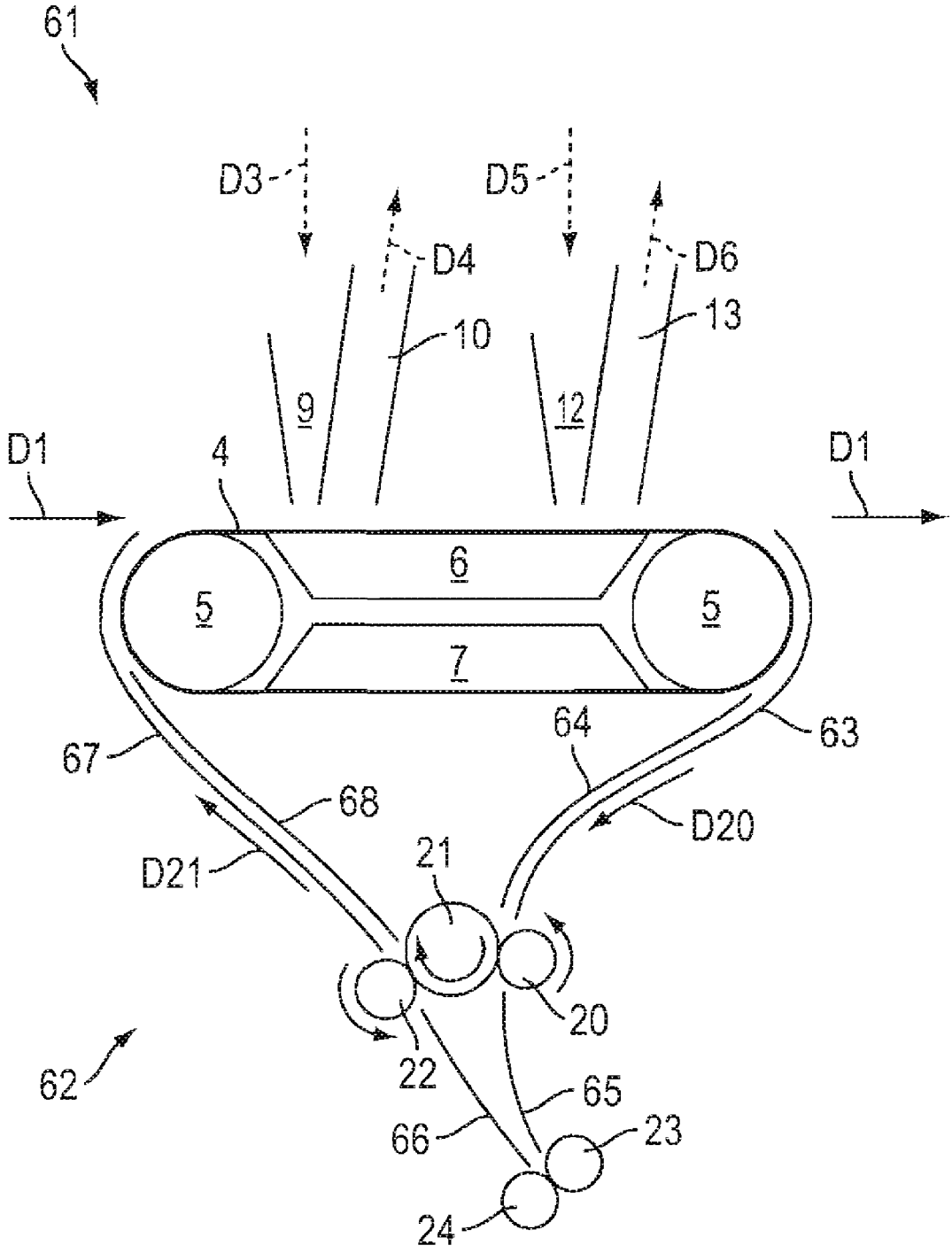
FIG. 3 is a schematic view of a duplex hot air convection glosser system using a sheet reverser described herein.

Referring to FIG. 3, hot air convective glosser system 61 is shown having a hot air convective glosser 2 and a sheet reverser 62.

As shown in FIG. 3, hot air convective glosser system 61 includes a hot air convective glosser 2 which can have any combination of features discussed in relation to FIG. 1. However, in hot air convective glosser system 61, upon the first pass through hot air convective glosser 2 by recording medium 100, sheet transporter 3 passes recording medium 100 to sheet reverser 62. Sheet reverser 62 reverses (inverts) recording medium 100 and supplies recording medium 100 back to hot air convective glosser such that the surface and image of recording medium 100 that was heated and reglossed on the first pass through hot air convective glosser 2 is now in contact with belt 4 and the surface and image of recording medium 100 that was in contact with belt 4 on the first pass through hot air convective glosser 2 is now exposed to hot air for reglossing.

As shown in FIG. 3, sheet reverser 62 receives recording medium 100 from sheet transporter 3. Recording medium 100 is guided in direction D20 between guides 63 and 64 to rollers 20 and 21, then between guides 65 and 66 and rollers 23 and 24. At this point, the movement of recording medium 100 stops and reverses under the rotation of rollers of 23 and 24, moves between rollers 21 and 22 in direction D21, between guides 67 and 68 whereupon recording medium is inverted and supplied back to sheet transporter 3. Upon completion of a second pass through hot air convection glosser 2, sheet transporter 3 then passes recording medium 100 on to the next component in electrophotographical system or other system of which it is a part, or on to an output bin or other facility.

The configuration of sheet reverser 62 as depicted and discussed is by way of example only. Other configurations and methods of reversing recording medium 100 are possible.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A hot air convection glosser that increases the glossiness of a toner image formed on a sheet, the glosser comprising:

a sheet transporter operable to receive the sheet to which the toner image has been fixed and to transport the sheet; and a heating unit that blows hot air onto the toner image to heat the toner image, the hot air having a temperature of about 250-300 degrees Fahrenheit.

2. A hot air convection glosser as in claim 1, the glosser further comprising:

a hot air remover that removes the hot air after the hot air has been provided to the toner image.

3. A hot air convection glosser as in claim 1, wherein the heating unit includes a resistive heating device and a blower.

4. A hot air convection glosser as in claim 1, wherein the sheet transporter comprises:

a sheet transportation surface operable to receive the sheet and support the sheet during transportation, the sheet transportation surface having pores; and a sheet holder for holding the sheet on the sheet transportation surface, the sheet holder including a plenum under the sheet transportation surface operatively coupled to a vacuum source, wherein a vacuum is provided in the plenum acting on the sheet through the pores to hold the sheet on the sheet transporter.

5. A hot air convection glosser as in claim 4, wherein the pores have a maximum diameter equal to or less than about one-half of the thickness of the sheet.

6. A hot air convection glosser as in claim 4, further comprising:

a sheet transporter cooling unit operable to cool at least a portion of the sheet transporter when not in contact with the sheet.

7. A hot air convection glosser as in claim 1, further comprising:

a second sheet transporter and a second heating unit located downstream and inverted with respect to the sheet transporter and the heating unit, wherein the second sheet transporter has a second sheet transportation surface which receives the sheet from the sheet transporter such that the side of the sheet exposed to the hot air during transport by the sheet transporter is in contact with the second sheet transportation surface, whereby the hot air convection glosser is capable of duplex operation.

8. A hot air convection glosser as in claim 1, further comprising:

a sheet inverting unit that receives the sheet from the sheet transporter and provides the sheet back to the sheet transporter inverted from an orientation in which the sheet was received, whereby the hot air convection glosser is capable of duplex operation.

9. A xerographic device for producing an image on a sheet comprising:

the hot air convection glosser as in claim 1.

10. A hot air convection glosser that increases the glossiness of a toner image formed on a sheet, the glosser comprising:

a sheet transporter operable to receive the sheet to which the toner image has been fixed and to transport the sheet;

a heating unit that blows hot air onto the toner image to heat the toner image; and a cooling unit that blows cooling air onto the toner image.

11. A hot air convection glosser as in claim 10, wherein the cooling air is supplied by the air contained in an environment surrounding the glosser.

12. A hot air convection glosser as in claim 10, wherein the cooling air is supplied by a refrigeration unit.

13. A hot air convection glosser as in claim 10, further comprising:

a cooling air remover that removes the cooling air after the cooling air has been blown onto the toner image.

14. A hot air convection glosser as in claim 10, the glosser further comprising:

a hot air remover that removes the hot air after the hot air has been provided to the toner image.

15. A hot air convection glosser as in claim 10, wherein the heating unit includes a resistive heating device and a blower.

16. A hot air convection glosser as in claim 10, wherein the hot air has a temperature of about 250-300 degrees Fahrenheit.

17. A hot air convection glosser as in claim 10, wherein the sheet transporter comprises:

a sheet transportation surface operable to receive the sheet and support the sheet during transportation, the sheet transportation surface having pores; and a sheet holder for holding the sheet on the sheet transportation surface, the sheet holder including a plenum under the sheet transportation surface operatively coupled to a vacuum source, wherein a vacuum is provided in the plenum acting on the sheet through the pores to hold the sheet on the sheet transporter.

18. A hot air convection glosser as in claim 10, further comprising:

a second sheet transporter and a second heating unit located downstream and inverted with respect to the sheet transporter and the heating unit, wherein the second sheet transporter has a second sheet transportation surface which receives the sheet from the sheet transporter such that the side of the sheet exposed to the hot air during transport by the sheet transporter is in contact with the second sheet transportation surface, whereby the hot air convection glosser is capable of duplex operation.

19. A hot air convection glosser as in claim 10, further comprising:

a sheet inverting unit that receives the sheet from the sheet transporter and provides the sheet back to the sheet transporter inverted from an orientation in which the sheet was received, whereby the hot air convection glosser is capable of duplex operation.

20. A hot air convection glosser that improves the gloss of a toner image fixed on a substrate, comprising:

sheet transportation means for receiving the sheet and transporting the sheet;

convective heating means for convectively heating at least a portion of the toner image during transport of the sheet;

hot air removal means for removing the hot air after the hot air has been provided to the toner image;

sheet inverting means for inverting the sheet and providing the sheet back to the sheet transportation means; and wherein a second toner image of the sheet on a different side of the sheet than the side of the toner image is convectively heated.

* * * * *